United States Patent [19]

Horton

[11] 4,201,662

[45] May 6, 1980

[54] PROCESS FOR CONVERTING SULFUR IN HYDROCARBON TO WATER SOLUBLE FORM

[75] Inventor: Robert L. Horton, Bartlesville, Okla.

[73] Assignee: Phillips Petroleum Company, Bartlesville, Okla.

[21] Appl. No.: 26,502

[22] Filed: Apr. 3, 1979

[51] Int. Cl.[2] ..... C10G 29/20; C10G 27/00; C10G 19/02

[52] U.S. Cl. ..... 208/228; 208/236; 208/242; 44/1 B

[58] Field of Search ..... 208/242, 224, 236, 8 LE, 208/8 R; 44/1 B, 1 C, 1 G

[56] References Cited

U.S. PATENT DOCUMENTS

| | | | |
|---|---|---|---|
| 2,049,016 | 7/1936 | Morrell | 208/224 |
| 2,247,927 | 7/1941 | Smith | 208/224 |
| 3,091,587 | 5/1963 | Klass et al. | 208/242 |
| 3,607,716 | 9/1971 | Roach | 208/8 LE |
| 3,829,521 | 8/1974 | Green | 208/236 |
| 4,120,664 | 10/1978 | Gleim | 208/8 LE |

*Primary Examiner*—George Crasanakis

[57] ABSTRACT

A desulfurization process wherein a sulfur-containing hydrocarbon material is contacted with a sulfur oxide compound and an amine, a salt of an amine, or mixtures thereof. The contacting converts the sulfur component of the hydrocarbon material to water soluble form thereby allowing the sulfur components to be readily separated by water washing.

13 Claims, No Drawings

PROCESS FOR CONVERTING SULFUR IN HYDROCARBON TO WATER SOLUBLE FORM

BACKGROUND OF THE INVENTION

This invention relates to the desulfurization of sulfur-containing hydrocarbon material. In another aspect, this invention relates to a method of desulfurizing sulfur-containing hydrocarbon material by converting the sulfur components into a water soluble form. Yet another aspect of this invention relates to a desulfurization of sulfur-containing hydrocarbon material by contacting a hydrocarbon material with a sulfur oxide compound and an amine, a salt of an amine or mixtures thereof. In still another aspect, this invention relates to contacting sulfur-containing hydrocarbon material with a sulfur oxide compound and an amine or a salt of an amine to thereby convert the sulfur components to water soluble form and then separating said sulfur components by water washing. In still another aspect, this invention relates to the removal of thiophene and its derivatives from a hydrocarbon material by contacting the hydrocarbon material with a sulfur oxide compound and an amine or salt thereof. Still another aspect of this invention relates to the removal of sulfur components such as thiophene and its derivatives from coal, coal liquids and crude oil by converting the sulfur components to water soluble form by contacting said coal, coal liquids, or crude oil with a sulfur oxide compound and an amine, a salt of an amine, or mixtures thereof.

The presence of sulfur in a hydrocarbon material can many times be a problem. The removal of the sulfur, therefore, becomes very important. This is especially true in the petroleum field where for many petroleum processes the sulfur present in the petroleum refinery streams must be removed as at high levels sulfur is objectionable for environmental reasons and at low levels sulfur is a poison for a number of catalysts. Sulfur is generally present in hydrocarbon material as hydrogen sulfide, mercaptans, sulfides and thiophenic compounds. Of these, the thiophenic materials are the most refractory. The removal of thiophenic components by conventional methods such as hydrotreating, therefore, requires severe conditions.

Accordingly, it is an object of this invention to provide an easy and efficient method for desulfurizing a sulfur-containing hydrocarbon material.

Another object of this invention is to provide a method of removing sulfur from coal, coal liquids, and crude oil without requiring high temperature and pressure.

Another object of this invention is to provide a method which allows the removal of thiophene and its derivatives from a hydrocarbon material by simple water washing.

Other objects, aspects, and the several advantages of this invention will be apparent to those skilled in the art upon a study of this disclosure and the appended claims.

SUMMARY OF THE INVENTION

This invention provides a method for converting the sulfur components of a sulfur-containing hydrocarbon material to a water soluble form. The sulfur can thereby be readily removed by simple water washing. A sulfur-containing hydrocarbon material is contacted with a sulfur oxide compound and a promoter selected from the group consisting of amine, amine salts, or mixtures thereof. Preferred promoters are alkylamines, ammonium thiosulfates, alkylammonium thiosulfates, ammonium sulfites and alkylammonium sulfites.

In a preferred embodiment, the method of the present invention is used to desulfurize coal, coal liquids and crude oil. The method of the present invention has special application to the removal of thiophene or derivatives thereof as conventional desulfurization means are ineffectual in removing this type of sulfur.

Once the sulfur components have been converted to water soluble form by contacting with a sulfur oxide compound and an amine promoter, the sulfur can be removed by simple water washing or in conjunction with well known sulfur removal techniques, e.g., washing with caustic solution.

DETAILED DESCRIPTION OF THE INVENTION

The present invention is directed to the removal of sulfur from sulfur-containing hydrocarbon material. The sulfur removal is accomplished by converting the sulfur components in the hydrocarbon material to a water soluble form.

Sulfur can exist in hydrocarbon material in many different forms and the present invention is appropriate for the removal of sulfur in whatever form it exists, either inorganic or organic. An example of some of the organic forms in which sulfur exists in hydrocarbon material includes thiophene and its derivatives, mercaptans, sulfides and disulfides.

The present invention has special application to the removal of thiophene and its derivatives. Thiophenic sulfur is generally difficult to remove by conventional desulfurization means. For example, removal by conventional hydrotreating requires severe conditions of temperature and pressure. The present invention, however, provides a method of removing sulfur, especially thiophenic compounds, without requiring high temperature and pressure.

The type of hydrocarbon material to which this invention is applicable can be derived from any source of hydrocarbonaceous material, including coal, petroleum, etc. Examples of sulfur-containing hydrocarbon materials which can be desulfurized by the process of the present invention include coal, coal liquids and crude oil.

The sulfur is removed by contacting the hydrocarbon material with a sulfur oxide oxidant and an amine promoter to thereby convert the sulfur components to a water soluble form. The sulfur oxide oxidants can be sulfur dioxide or sulfur trioxide with sulfur dioxide being most readily available and preferred. Both $SO_2$ and $SO_3$ are commercially available and can be used in the commercially available form as the form of the sulfur oxide oxidant is not important.

The amine promoter can be any amine, amine salt or mixture thereof. Preferred amine promoters can be selected from the group consisting of alkylamines, ammonium thiosulfates, alkylammonium thiosulfates, ammonium sulfites, alkylammonium sulfites and mixtures thereof. Examples of various appropriate amine promoters include methylamine, ethylamine, propylamine, dimethylamine, diethylamine, dipropylamine, trimethylamine, triethylamine, tripropylamine, etc., ethylenediamine, aniline, ammonium thiosulfate, ammonium sulfite, ethylammonium thiosulfate, diethyl ammonium thiosulfate and ethylammonium sulfite, anilinium thiosulfate, anilinium sulfite, among others.

In general, the process of this invention is carried out by contacting the sulfur-containing hydrocarbon material, such as coal, coal liquids or crude oil, in the presence of an amine promoter for a length of time and under conditions sufficient to effect reaction of the sulfur components with the $SO_2$ or $SO_3$. The amine promoter is used at a concentration which is sufficient to promote the reaction. Generally, a catalyst concentration in the range of about 1 ppm to about 5 wt. percent based on the weight of the sulfur-containing hydrocarbon material is appropriate for the present invention, however, more or less can be used. The concentration of $SO_2$, or $SO_3$, employed is generally dependent upon the weight percent of sulfur present in the hydrocarbon material with the amount being sufficient to react with all of the sulfur components in the hydrocarbon material. As a guide, the mole ratio of $SO_2$ to sulfur components in the hydrocarbon material can be generally in the range of about 0.1 to about 50 moles of $SO_2$ per 1 mole of sulfur, more preferredly from about 0.8 to about 2.2 moles of $SO_2$ per mole of sulfur.

The conditions of time, temperature and pressure utilized in carrying out the process are not critical. Severe conditions as utilized in conventional hydrotreating of sulfur-containing hydrocarbon material are not, however, necessary for the present invention. Generally, the temperature utilized in carrying out the reaction can be in the range of about 30° F. (−1° C.) to about 450° F. (232° C.), preferably from about 240° F. (116° C.) to about 300° F. (149° C.). The process can be carried out at atmospheric pressure although pressures up to about 60 atmospheres, or even higher, can be utilized. The residence time or contacting time of the $SO_2$, amine promoter and sulfur-containing hydrocarbon can vary greatly. Generally, a residence time of about 2 seconds to about 2 hours can be employed, with the preferred residence time being in the range of about 15 to about 150 seconds.

Once the reaction has taken place and the sulfur components have been converted to a water soluble form, the sulfur can be removed by simple water washing. Any conventional method appropriate for the removal of water soluble components can be employed in separating the sulfur compounds from the hydrocarbon material such as coal, coal liquids or crude oil. Washing with a caustic solution is another method which can be employed.

A better understanding of the invention will be obtained upon reference to the following illustrative examples. The following calculated examples are set forth as illustrative of the process of this invention and are not meant to be restrictive.

CALCULATED EXAMPLE I

This example illustrates the desulfurization of non-caking coal or lignite.

$SO_2$ is used as the oxidant to oxidize the sulfur impurities in coal. (See note "a".) Sulfur dioxide is used in the form of commercially available mixture containing 99 percent sulfur dioxide. Water is not added as a solvent in the oxidation reaction but is present in the coal and amounted to about 98 percent by weight of the oxidation-reduction mixture excluding non-sulfur components. Non-sulfur components in the coal are not included as reagents with regard to the calculation of percent by weight.

Diethylamine is used as catalyst to catalyze the oxidation reaction. Diethylamine is used in the form of commercially available mixture containing 95 percent diethylamine. A lower quality mixture of several alkylamines can also be used.

The oxidation reaction mixture is formed by combining coal with diethylamine catalyst at a ratio of 73 milligrams catalyst per 100 grams of coal. 100 grams of this mixture is placed in a heated glass flask. Sulfur dioxide is passed through the flask in a rate of $5\times10^{-3}$ SCF/hr throughout the reaction period. The flask is heated to about 98° to 101° C. causing the reaction mixture to reflux. This temperature is maintained for 2 hours to effect sulfur oxidation. After the reaction, the remaining coal is thoroughly washed with water. Sulfur content of the washed coal is determined. About 30 percent of the sulfur originally contained in the coal is removed. Yet further desulfurization by well-known methods can be effected subsequent to the treatment described above.

Note "a"

The coal used is a Wilcox trend lignite designated Panther Hill Pit #1. This coal is mined from a Phillips lease located in Eastern Texas. Average analyses of two batches of this coal are given in Table I. For all the tests, the coal is ground to at least 300 mesh before it is used.

Table I

Average Properties of Panther Hill Pit #1 Lignite Coal

| Property | Batch A | Batch B |
|---|---|---|
| Proximate Analysis | | |
| % moisture | 28.4 ± .6 | 30.0 ± 1.6 |
| % ash | 9.35 ± 0.41 | 13.86 ± 0.91 |
| % volatile | 41.9 ± 4.3 | 38.0 ± 1.3 |
| Ultimate Analysis | | |
| % carbon | 50.3 ± 2.3 | 50.9 ± 0.8 |
| % hydrogen | 4.6 ± 0.3 | 4.9 ± 0.2 |
| % nitrogen | 0.91 ± 0.08 | 0.87 ± 0.02 |
| % sulfur | 0.41 ± 0.03 | 0.38 ± 0.03 |

CALCULATED EXAMPLE II

This example illustrates the desulfurization of crude oil.

As in Example I, sulfur dioxide is used as oxidant to oxidize thiophene and its derivatives in crude oil. (See note "b".) Commercially available ammonium thiosulfate about 80 percent purity is used as catalyst.

100 ml crude oil and 100 ml of 10 wt % ammonium thiosulfate solution in water is placed in equipment similar to that described in Example I and heated to about 50° C. with rapid stirring for about 10 minutes. $SO_2$ is sparged in at $6\times10^{-2}$ SCF/hr. After the reaction, the product is stripped essentially free of sulfur dioxide, ammonium thiosulfates, water, and light components.

The remaining hydrocarbon product placed in a glass vessel with hot (220° F.) caustic solution (about 5 wt percent) to dissolve caustic-soluble sulfur. The mixture is stripped free of caustic solution and the remaining liquid product is sampled and analyzed for sulfur content. About 90 percent of the sulfur originally contained in crude oil is removed.

Note "b"

Table II

Average Sulfur Contents of Crude Oil

| Crude Oil | Average wt % sulfur |
|---|---|
| Typical Gulf Coast | 0.19 |

Table II-continued

| Average Sulfur Contents of Crude Oil | |
|---|---|
| Crude Oil | Average wt % sulfur |
| East Texas field | 0.26 |
| California | 1.05 |
| Average U.S. | 0.75 |
| Mississippi | 1.60 |
| West Texas | 1.38 |

Reasonable variations and modifications are possible within the scope of the foregoing disclosure and the appended claims.

I claim:

1. A method for desulfurizing a sulfur-containing hydrocarbon material by converting the sulfur to a form readily soluble in water which comprises:

contacting said sulfur-containing hydrocarbon material with a sulfur oxide oxidant selected from the group consisting of sulfur dioxide and sulfur trioxide and an amine promoter selected from the group consisting of an amine, a salt of an amine, and mixtures thereof, for a period of time and under conditions sufficient for a reaction to occur between the sulfur and the sulfur oxide oxidant.

2. The method of claim 1 wherein said amine promoter is selected from the group consisting of an alkyl amine, an ammonium thiosulfate, an alkylammonium thiosulfate, an ammonium sulfite, and an alkylammonium sulfite, and said sulfur oxide oxidant is sulfur dioxide.

3. The method of claim 1 wherein said sulfur in said sulfur-containing hydrocarbon material is present in the form of thiophene or a derivative thereof.

4. A method in accordance with claim 3 wherein the amount of amine promoter employed is in the range of about 0.0001 to about 5 wt. percent based on the weight of the sulfur-containing hydrocarbon material being desulfurized and the mole ratio of sulfur oxide oxidant to thiophene material is in the range of about 0.1 to about 50 moles of sulfur oxide oxidant per mole of thiophene.

5. The method of claim 4 wherein the mole ratio of sulfur oxide oxidant employed to thiophene material present in the sulfur-containing hydrocarbon material is in the range of about 0.8 to about 2.2 moles of sulfur oxide oxidant per mole of thiophene material.

6. The method of claim 1 wherein the temperature utilized in the contacting step is in the range of about 30° F. to about 450° F. and the residence time of said contacting step is in the range of about 2 seconds to about 2 hours.

7. The method of claim 6 wherein said temperature is in the range of about 240° to 300° F. and said residence time is in the range of about 15 seconds to about 150 seconds.

8. The method of claim 1 which further comprises a water washing step to remove the sulfur converted to a form readily soluble in water.

9. The method of claim 1 wherein said sulfur compounds converted to a form readily soluble in water are removed by subsequent treatment wherein said treatment is a washing step with a caustic solution.

10. The method of claim 1 wherein said sulfur-containing hydrocarbon material is selected from the group consisting of coal, coal liquids and crude oil.

11. The method of claim 10 wherein said sulfur-containing hydrocarbon material is coal, said amine promoter employed is diethylamine and said sulfur oxide oxidant is sulfur dioxide.

12. The method of claim 10 wherein said sulfur-containing hydrócarbon material is crude oil, said amine promoter is ammonium thiosulfate, and said sulfur oxide oxidane is sulfur dioxide.

13. The method of claim 10 wherein said sulfur-containing hydrocarbon material is coal liquids.

* * * * *